US006461669B1

(12) United States Patent
Hanano et al.

(10) Patent No.: US 6,461,669 B1
(45) Date of Patent: Oct. 8, 2002

(54) COATING MECHANISM AND COATING METHOD OF POWDERY MOLD RELEASING AGENT

(75) Inventors: Takashi Hanano; Hisataka Shibuya, both of Kobe (JP)

(73) Assignee: Hanano Corporation, Kobe (JP)

( * ) Notice: Subject to any disclaimer, the term of this patent is extended or adjusted under 35 U.S.C. 154(b) by 0 days.

(21) Appl. No.: 09/658,265

(22) Filed: Sep. 8, 2000

(30) Foreign Application Priority Data

Sep. 22, 1999 (JP) ..... 11-268517

(51) Int. Cl.[7] ..... B05D 7/22; B05D 5/08; B22D 17/00

(52) U.S. Cl. ..... 427/135; 427/133; 427/181; 427/238; 427/239; 427/294; 427/295; 118/50; 164/271

(58) Field of Search ..... 427/133, 135, 427/294, 295, 181, 195, 189, 238, 239; 118/50; 164/271

(56) References Cited

U.S. PATENT DOCUMENTS 3,409,456 A * 11/1968 Derror ..... 118/308
4,472,451 A * 9/1984 Mulder ..... 118/301
4,775,554 A * 10/1988 Ponjee ..... 427/133
5,478,515 A * 12/1995 Waatti et al. ..... 23/303
6,159,535 A * 12/2000 Lutz et al. ..... 427/133

FOREIGN PATENT DOCUMENTS

DE 27 24 705 12/1977

* cited by examiner

*Primary Examiner*—Shrive P. Beck
*Assistant Examiner*—Kirsten A. Crockford
(74) *Attorney, Agent, or Firm*—Crowell & Moring LLP

(57) ABSTRACT

There provided a powder supply means for supplying a powdery mold releasing agent to a basin and a pressure reduction means for reducing a pressure in a cavity, and in a casting work the powdery mold releasing agent is supplied through a basin into a cavity while reducing a pressure in the cavity.

12 Claims, 2 Drawing Sheets

COATING MECHANISM AND COATING METHOD OF POWDERY MOLD RELEASING AGENT

BACKGROUND OF THE INVENTION

This invention relates to a mechanism and a method for coating a powdery mold releasing agent on a cavity surface, in a casting work and especially in a die casting work.

A mold releasing agent for use in the die casting work is roughly classified into a water-soluble mold releasing agent and an oily mold releasing agent. Since the oily mold releasing agent includes such problems as causing a danger of inflammability and worsening of a work environment due to fuming smoke etc., the water-soluble mold releasing agent has been used more frequently than the oily mold releasing agent. However, the water-soluble mold releasing agent includes such a problem as requiring a cost for operation and a cost for equipment in order to treat waste water after use. While, a quality level of cast product is becoming high, at present. For this reason, a powdery mold releasing agent which can eliminate the cost for treating the waste water after use and is more excellent in mold releasing ability, has become used more frequently.

The powdery mold releasing agent is generally composed of an inorganic powder such as graphite, talc etc. and an organic powder such as wax, resin, metal soap etc. for enhancing adhesiveness of the inorganic powder onto the cavity surface. Since the powdery mold releasing agent is used under a powdery state, the powdery mold releasing agent disperses into atmosphere to deteriorate the work environment when the powdery mold releasing agent is spray-coated onto the cavity surface while opening the metal mold as in case of the oily mold releasing agent and the water-soluble mold releasing agent. Therefore, the powdery mold releasing agent is used while closing the metal mold.

The powdery mold releasing agent has so far been supplied from a sleeve of molten metal injection portion through a runner into a cavity. However, this supply method has included such a problem as being unable to obtain a cast product of high quality due to following troubles.

(1) Since the powdery mold releasing agent adheres to sleeve inside surface and runner, seizure occurs on the cast product due to insufficiency of a supply of powdery mold releasing agent to the cavity.

(2) The powdery mold releasing agent deposits around the runner so as to impair smooth flow of molten metal, so that the molten metal does not spread completely into the cavity to cause inaccuracy of the shape and size of cast product.

(3) The powdery mold releasing agent adhering to the sleeve inside and runner flows together with the molten metal and is caught up in it, so that the powdery mold releasing agent becomes a cause of inside defect of the cast product.

SUMMARY OF THE INVENTION

An object of this invention is to provide a coating mechanism and a coating method of powdery mold releasing agent for dissolving the foregoing problems and obtaining a cast product of high quality even when the powdery mold releasing agent is used.

A first invention of this application comprises a mechanism for coating the powdery mold releasing agent onto a cavity surface in the casting work; characterized by that the mechanism has a powder supply means for supplying the powdery mold releasing agent to a basin and a pressure reduction means for reducing a pressure in the cavity, so that the powdery mold releasing agent is supplied to the basin while operating the pressure reduction means.

A second invention of this application comprises a method for coating the powdery mold releasing agent onto a cavity surface in the casting work; characterized by that the powdery mold releasing agent is supplied through the basin into the cavity while reducing a pressure in the cavity.

DETAILED DESCRIPTION OF THE PREFERRED EMBODIMENT

Figure 1:
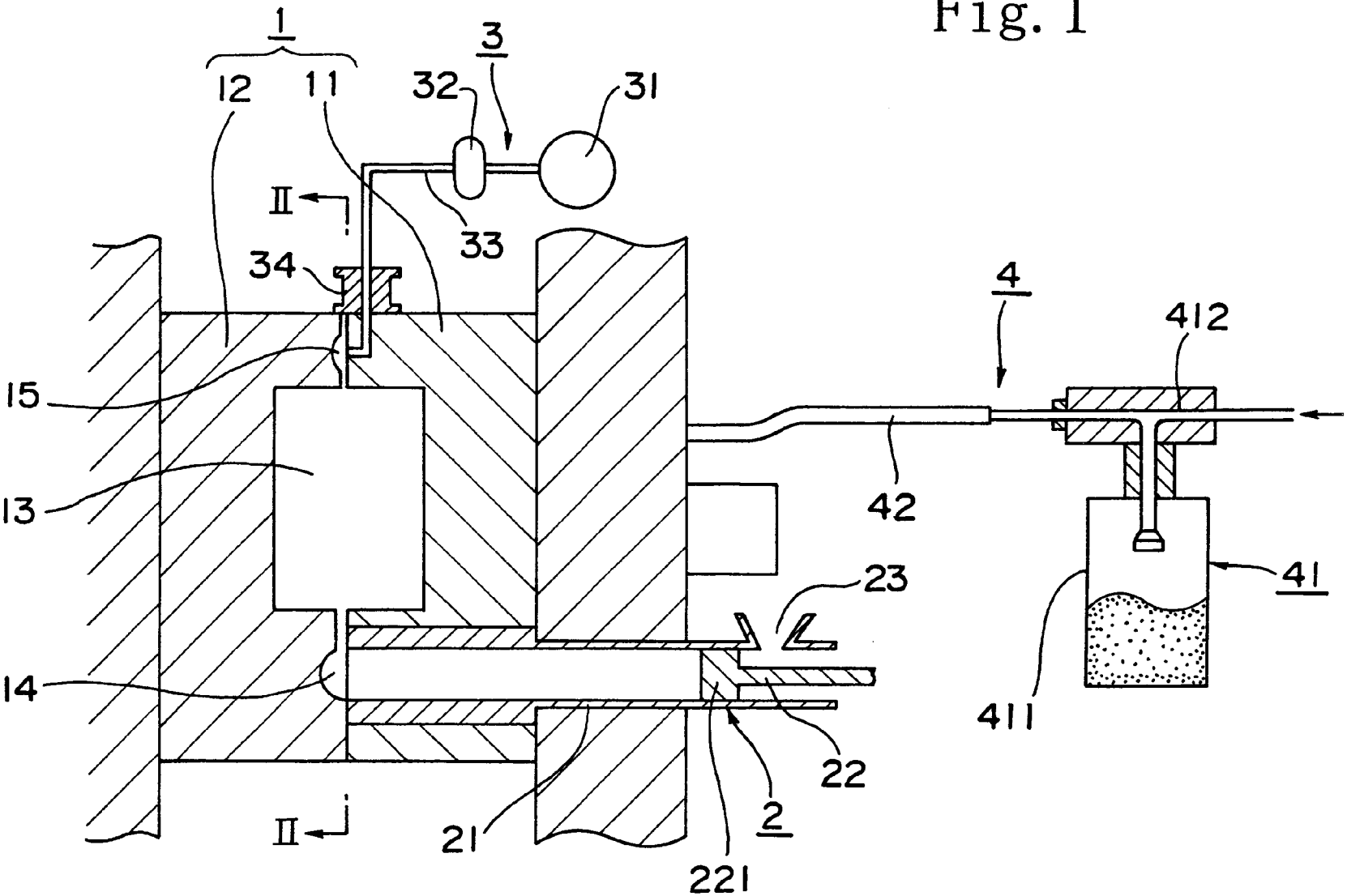
FIG. 1 is a vertical sectional view showing a casting. machine equipped with the coating mechanism of this invention.

FIG. 1 is the vertical sectional view showing the casting machine equipped with the coating mechanism of this invention. This casting machine is composed of a metal mold 1, a molten metal injection means 2, a pressure reduction means 3, and a powder supply means 4. The coating mechanism of this invention is composed of the pressure reduction means 3 and the powder supply means 4.

Figure 2:
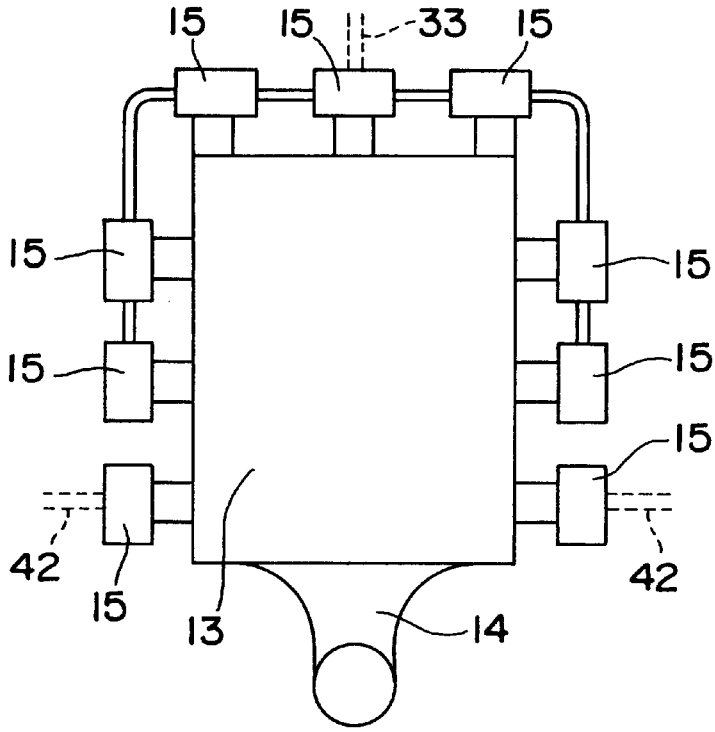
FIG. 2 is a sectional view taken on and viewed in a direction of arrows II—II of FIG. 1.

The metal mold 1 comprises a fixed metal mold 11 and a movable metal mold 12. When the both metal molds 11 & 12 are mated each other; a cavity 13, a runner 14 and a large number of basins 15 are formed at a mating surface. FIG. 2 is the sectional view taken on and viewed in the direction of arrows II—II, and nine basins 15 are formed around the cavity 13.

The molten metal injection means 2 comprises a sleeve 21 passing through the fixed metal mold 11 and a plunger 22 sliding in the sleeve 21, so that a molten metal supplied from a supply port 23 into the sleeve 21 is pushed by a tip 221 of the plunger 22 and supplied through the runner 14 to the cavity 13.

The pressure reduction means 3 is equipped with a vacuum pump 31 and a vacuum tank 32 so as to reduce a pressure in the cavity 13 through a vacuum passage 33 connecting to the basin 15. 34 is a vacuum shut-off valve.

Figure 3:
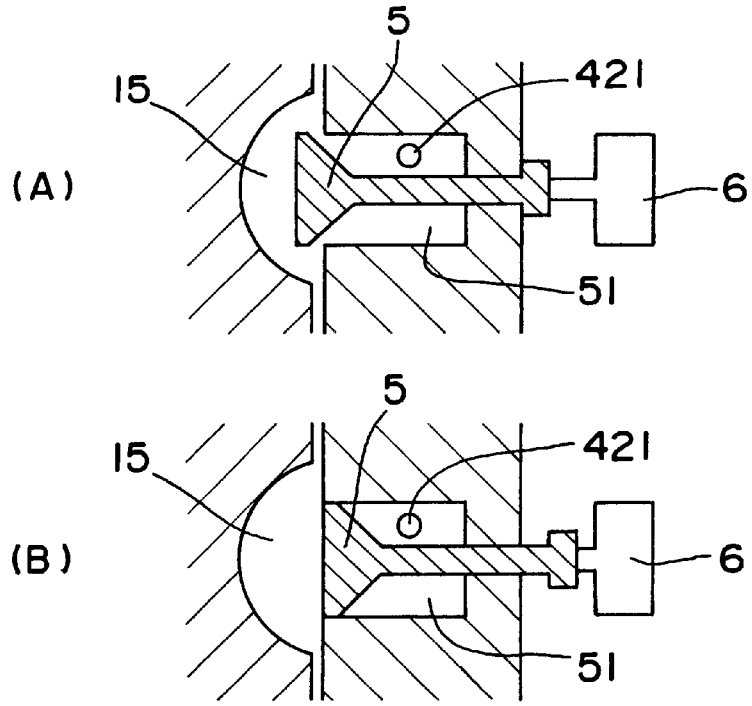
FIG. 3 is a sectional view showing a connection portion between a powder supply passage and a basin.

The powder supply means 4 is so designed as to supply the powdery mold releasing agent from a powder delivery device 41 through powder supply passages 42 to the basins 15. Namely, the powder supply passage 42 connects to the basin 15 with a switch valve 5 put between them as shown by FIG. 3. Here, the powder supply passage 42 connects to two basins 15 respectively, as shown by FIG. 2. FIG. 3(A) shows a state where the switch valve 5 is opened, and FIG. 3(B) shows a state where the switch valve 5 is closed. A supply port 421 at tip end of the powder supply passage 42 opens to a valve chamber 51, and the valve chamber 51 is so designed as to be connected to the basin 15 when the switch valve 5 moves forward, and to be shut from the basin 15 when the switch valve 5 moves backward. Forward and backward movements of the switch valve 5 are operated by a pneumatic or hydraulic cylinder mechanism 6. The powder delivery device 41 is so designed as to suck and deliver the powdery mold releasing agent contained in a vessel 411 by means of delivery air flown into an ejector pipe 412.

The casting machine equipped with the coating mechanism having the above structure is operated as follows.

As illustrated in FIG. 1, the both metal molds 11 & 12 are closed and the tip 221 of the plunger 22 is located at a forward position of the molten metal supply port 23. The pressure reduction means 3 is operated in this state so as to reduce the pressure in the cavity 13. The switch valve 5 is opened as shown by FIG. 3(A) while reducing the pressure in the cavity 13, the powder supply means 4 s operated in this state. Thereby, the powdery mold releasing agent is supplied into the cavity 13 through the powder supply passages 42 and the basins 15 so as to be coated on a surface of the cavity 13. When the supply of specified quantity of the powdery mold releasing agent is completed, the operation of the powder supply means 4 is stopped, and the switch valve 5 is closed to stop the operation of the pressure reduction means 3 as shown by FIG. 3(B). Then, the plunger 22 is moved backward to supply the molten metal from the molten metal supply port 23 into the sleeve 21, and the plunger 22 is moved forward to supply the molten metal through the runner 14 into the cavity 13. After completion of molding, the both metal molds 11 & 12 are opened to take out the cast product.

Since the powdery mold releasing agent is supplied through the basins 15 to the cavity 13 in the above operation, following effects become obtainable.

(1) One basin 15 has a small volume, and located near to the cavity 13. For this reason, when the powdery mold releasing agent is supplied through the basin 15 into the cavity 13, a quantity of the powdery mold releasing agent is very small even if it adheres to the basin 15, and almost all of it will be supplied into the cavity 13. Therefore, the cavity 13 will be supplied with a sufficient quantity of the powdery mold releasing agent, so that the seizure of cast product can be prevented.

(2) Since the powdery mold releasing agent does not adhere to the sleeve 21 inside and the runner 14, the molten metal is smoothly supplied to the cavity 13. Therefore, the molten metal is supplied enough into the cavity 13 so that the shape and size of the cast product becomes accurate.

(3) Since the powdery mold releasing agent does not adhere to the sleeve 21 inside and the runner 14, there is no chance for the powdery mold releasing agent to be caught up in the molten metal. Therefore, the powdery mold releasing agent does not become a cause of inside defects of the cast product.

(4) Even when the powdery mold releasing agent adheres excessively onto the surface of the cavity 13, an excess powdery mold releasing agent is discharged to the basins 15 together with a previous running dirty molten metal and gas. Therefore, the normal effect of the powdery mold releasing agent can be maintained.

Comparison tests between coating method of this invention and conventional coating method were carried out under following conditions, in concrete. Results are listed in Table 1.

Casting machine: 350-ton horizontal-type cold chamber die-cast machine

Molten metal material: ADC-12 aluminum alloy for die-casting

Cast product: Automobile parts

Powdery mold releasing agent: Commercial product consisting of graphite, talc and polyethylene wax Supply time of powdery mold releasing agent: 0.5 sec.

Cavity inside pressure when supplying powdery mold releasing agent: 650 mmHg

Shot number: 250

TABLE 1

| | This invention method | Conventional method |
|---|---|---|
| Number of defect due to caught-up of powdery mold releasing agent in cast product | 0 | 24 |
| Number of defect due to inaccurate size etc. of cast product | 0 | 18 |
| Existence of deposit of powdery mold releasing agent near to runner | Non-exist | Exist |

As seen from Table 1, a high-quality cast product can be obtained according to the coating method of this invention.

The powdery mold releasing agent is supplied from a side of the fixed metal mold 11 in the coating mechanism having the above structure, however, it may be supplied from a side of the movable metal mold 12. The type-of supply can be selected at will depending on a shape of the cast product.

As mentioned above, since the powdery mold releasing agent is supplied through the basin according to this invention, following effects become obtainable.

(1) A sufficient quantity of the powdery mold releasing agent can be supplied to the cavity, so that the seizure of cast product can be prevented.

(2) The molten metal can be supplied enough into the cavity, so that the shape and size of the cast product can be made accurate.

(3) The caught-up of powdery mold releasing agent into the molten metal can be avoided, so that the inside defect of the cast product can be prevented.

(4) An excessive powdery mold releasing agent on the cavity surface can be discharged to the basin, so that the normal effect of powdery mold releasing agent can be maintained.

What is claimed is:

1. A method for coating a powdery mold releasing agent onto a cavity surface in a casting mold comprising supplying the powdery mold releasing agent into a cavity of the mold and onto the cavity surface through a basin while reducing a pressure i the cavity, wherein the basin and the cavity are formed by mating a surface of a first mold member with a surface of a second mold member.

2. The method of claim 1 wherein the step of forming the basin and the cavity includes moving the second mold member to mate with a fixed first mold member.

3. The method of claim 1 wherein the basin is disposed adjacent to the cavity.

4. The method of claim 1 wherein a plurality of basins are formed by the mating of the first mold member and the second mold member and wherein the plurality of basins are disposed adjacent to and around the cavity.

5. The method of claim 1 wherein the surfaces of the first mold member and the second mold member also form a channel extending between the basin and the cavity.

6. The method of claim 1 wherein the step of supplying the powdery mold releasing agent through the basin into the cavity includes moving a switch valve to a position where a portion of the switch valve extends into the basin.

7. A mechanism for coating a powdery mold releasing agent onto a cavity surface in a casting mold comprising a powder supply for supplying the powdery mold releasing agent to a basin and a pressure reduction device for reducing a pressure in a cavity, in which the powdery mold releasing agent is supplied to the basin while operating the pressure reduction device, wherein the basin a the cavity are formed by mating surfaces of a first mold member and a second mold member.

8. The mechanism of claim 7 wherein the first mold member is fixed and the second mold member is movable.

9. The mechanism of claim 7 wherein the basin is disposed adjacent to the cavity.

10. The mechanism of claim 7 wherein a plurality of basins are formed by the mating surfaces of the first mold member and the second mold member and wherein the plurality of basins are disposed adjacent to and around the cavity.

11. The mechanism of claim 7 wherein the mating surfaces of the first mold member and the second mold member also form a channel extending between the basin and the cavity.

12. The mechanism of claim 7 wherein a switch valve is operatively disposable within the basin between a first position where a portion of the switch valve extends into the basin to permit the powdery mold releasing agent to enter the basin and a second position where the portion of the switch valve does not extend into the basin and prevents the powdery mold releasing agent from entering the basin.

* * * * *